US007624503B2

(12) United States Patent
Fukuda

(10) Patent No.: US 7,624,503 B2
(45) Date of Patent: Dec. 1, 2009

(54) METHOD FOR MANUFACTURING WIRE HARNESS BRANCHING PORTION

(75) Inventor: Daisuke Fukuda, Utsunomiya (JP)

(73) Assignee: Yazaki Corporation, Tokyo (JP)

( * ) Notice: Subject to any disclaimer, the term of this patent is extended or adjusted under 35 U.S.C. 154(b) by 55 days.

(21) Appl. No.: 11/013,346

(22) Filed: Dec. 17, 2004

(65) Prior Publication Data

US 2005/0153576 A1 Jul. 14, 2005

(30) Foreign Application Priority Data

Dec. 19, 2003 (JP) ..... P2003-423062

(51) Int. Cl.
*H01R 43/00* (2006.01)

(52) U.S. Cl. ..... 29/872; 29/825; 29/868; 174/72 A

(58) Field of Classification Search ..... 29/33 F, 29/752, 755, 825, 872, 868, 564.4; 174/68.3, 174/72 R, 72 A; 228/538, 539; 439/34
See application file for complete search history.

(56) References Cited

U.S. PATENT DOCUMENTS 4,030,029 A * 6/1977 Cox ..... 29/755
4,114,014 A * 9/1978 Shogo et al. ..... 29/564.4
4,454,652 A * 6/1984 Suzuki et al. ..... 29/863
5,205,329 A * 4/1993 Suzuki et al. ..... 29/755
5,535,788 A * 7/1996 Mori et al. ..... 29/755
6,011,399 A * 1/2000 Matsumaru et al. ..... 324/538

FOREIGN PATENT DOCUMENTS

JP 60-135018 U 9/1985
JP 08-249934 A 9/1996
JP 2000-203355 A 7/2000
JP 3346282 B2 9/2002

* cited by examiner

*Primary Examiner*—Donghai D. Nguyen
(74) *Attorney, Agent, or Firm*—Sughrue Mion, PLLC

(57) ABSTRACT

Manufacturing is carried out while including the steps of: from a trunk line 12, drawing out electric wires 13*a* to be a branch line 14 longer than a required length of the branch line 14; forming a branch line portion 17 by applying tape winding to the drawn-out electric wires 13*a*; making, as a trunk line accompanying part 17*a*, a part from a base end P2 to a branching position P1 of the branch line portion 17 accompany the trunk line 12 and making, as a main branch line part 17*b*, a part from the branching position P1 to a front end P3 of the branch line portion 17 distant from the branch line 12; and applying an protecting treatment 19 by tape winding to the whole.

2 Claims, 4 Drawing Sheets

METHOD FOR MANUFACTURING WIRE HARNESS BRANCHING PORTION

BACKGROUND OF THE INVENTION

1. Technical Field

The present invention relates to a method for manufacturing a branching portion formed in various types of wire harnesses for automobile wiring, for example.

2. Related Art

As a method for preventing an exposure of electric wires at a branch line branching position of a wire harness, a technique disclosed in Japanese Patent Publication No. 3346282. According to the disclosed technique, first, as shown in FIG. 4(*a*), a longitudinal dimension of electric wires composing a branch line 1 is provided not as a minimum length to directly branch at a branching position P1 from a trunk line 2 but as a length provided with a U-turn formed turning portion 3.

Next, tape winding is applied for uniting and protecting the branch line 1 and branch line 2. Concretely, as shown in FIG. 4(*b*), tape winding is applied from the terminal side of the branch line 1, to which a connector 4 is connected, toward the branching position P1. At this time, at the branching position P1 side, the tape 5-1 wound around the branching line 1 is wound up to a U-turn turning point P2 of the U-turn turning portion 3, namely, a branch-line-side unilateral portion 3*a* of the turning portion 3.

Then, as shown in FIG. 4(*c*), for the trunk line 2, a tape 5-2 is wound from its one end. At this time, at the branching position P1, the tape 5-2 is wound up to the U-turn turning point P2 while uniting electric wires of the trunk line 2 and a branch-line-side unilateral portion 3*b* of the turning portion 3. By winding tape around the branch line 1 and trunk line 2 as such, an overlapping condition of the tape-wound trunk line 2 and branch line 1 sides is provided between the branching position P1 and U-turn turning point P2.

Then, as shown in FIG. 4(*d*) and FIG. 5, from the branching position P1 to the U-turn turning point P2, while uniting the previously tape-wound and overlapped electric wires of the trunk line 2 and branch line 1-side unilateral portion 3*a*, a tape 5-3 is wound around the outer circumference thereof. By the above, the electric wires of the trunk line 2 and branch line 1 are completely covered with the tape (5-1, 5-2, and 5-3). Accordingly, a partial exposure of the electric wires is prevented.

Lastly, as shown in FIG. 4(*e*), the tape 5-3 wound from the branching position P1 to the U-turn turning point P2 is wound up to the other end side of the trunk line 2, whereby the trunk line 2 is wound with tape across the entire length.

However, the above-described prior art has a problem in that, since the turning portion 3 is formed, the electric wires composing the branch line 1 have a long length, causing an influence on the cost, etc. In addition, it has a problem in that, since the electric wires composing the branch line 1 are bent, this causes breaking of wires or an influence on durability. Furthermore, it has a problem in that an increase in the number of electric wires composing the branch line 1 makes it difficult to form the turning portion 3. Still furthermore, the peripheral size of the branching position P1 is increased and sometimes fails to satisfy its standard. Still furthermore, it has a problem in that, when rigidity of the turning portion 3 is high, since the restoring force of the turning portion 3 (force to return to its original straight state) is increased, it becomes necessary to apply more tape winding, and as a result, the peripheral size of the branching position P1 is further increased.

SUMMARY OF THE INVENTION

The present invention has been made in view of the circumstances as described above, and an object thereof is to provide a method for manufacturing a wire harness branching portion which is easy to manufacture to lower the price, in addition, which has no worry of wire breaking and is excellent in durability, and furthermore, which can sufficiently satisfy the standard size.

A method for manufacturing a wire harness branching portion described in the first aspect of the present invention made in order to solve the problems as described above is provided in that, manufacturing is carried out while including the steps of: from a trunk line of a wire harness, drawing out electric wires to be a branch line longer than a required length of the branch line; forming a branch line portion by applying tape winding to the drawn-out electric wires; making, as a trunk line accompanying part, a part from a base end to a branching position of the branch line portion accompany the trunk line and making, as a main branch line part, a part from the branching position to a front end of the branch line portion distant from the trunk line; and applying an protecting treatment by tape winding to the whole.

A method for manufacturing a wire harness branching portion described in the second aspect of the present invention is provided in that, manufacturing is carried out while including the steps of: separating, out of a plurality of trunk lines composing a wire harness, a first trunk line including protecting target electric wires from a second trunk line not including protecting target electric wires; from the first trunk line, drawing out electric wires to be a protecting target branch line longer than a required length of the branch line; forming a protecting target branch line portion by applying tape winding to the drawn-out electric wires; making, as a trunk line accompanying part, a part from a base end to a branching position of the protecting target branch line portion accompany the first trunk line and making, as a main branch line part, a part from the branching position to a front end of the protecting target branch line portion distant from the first branch line; from the second trunk line, drawing out electric wires to be a general branch line with a required length of the branch line to provide as a general branch line portion and making the general branch line portion distant from the second trunk line; while aligning the main branch line part and general branch line portion in position, overlapping the first trunk line and second trunk line; and applying an protecting treatment by tape winding to the whole.

A method for manufacturing a wire harness branching portion described in the third aspect of the present invention is provided in that, manufacturing is carried out while including the steps of: from at least two trunk lines composing a wire harness, and including protecting target electric wires, drawing out electric wires to be, separately, protecting target branch lines longer than a required length of the branch lines; forming protecting target branch line portions by respectively applying tape winding to the drawn-out electric wires; making, as trunk line accompanying parts, parts from each base end to each branching position of the protecting target branch line portions accompany the trunk lines, respectively, and making, as main branch line parts, parts from each branching position to each front end of the protecting target branch line portions distant from the trunk lines, respectively; while aligning the main branch line parts in position with each other, overlapping the trunk lines with each other; and applying an protecting treatment by tape winding to the whole.

According to the present invention having such characteristics as in the above, manufacturing steps of shifting the drawing-out position of electric wires to be a branch line to a more upstream side than the branching position and protecting the section between the drawing-out position and branching position by tape winding are included. Namely, a manufacturing step of protecting, not only the section from the branching position to the front end of the branch line, but also the upstream side beyond the branching position by tape winding is included.

According to the present invention described in the first to third aspects, respectively, since it is unnecessary to lengthen the length of electric wires composing the branch line, and in addition, it is also unnecessary to provide a U-turn formed turning portion as in the prior art, productivity can be heightened to provide a wire harness branching portion at a low price. Furthermore, as described above, since it is unnecessary to provide a U-turn formed turning portion, occurrence of wire breaking can be prevented and durability can be improved. Still furthermore, an advantage is provided in that a compact wire harness branching portion can be manufactured. Therefore, the present invention has an effect in providing a method for manufacturing a wire harness branching portion which is easy to manufacture to lower the price, in addition, which has no worry of wire breaking and is excellent in durability, and furthermore, which can sufficiently satisfy the standard size.

DETAILED DESCRIPTION OF THE PREFERRED EMBODIMENTS

Figure 1A:
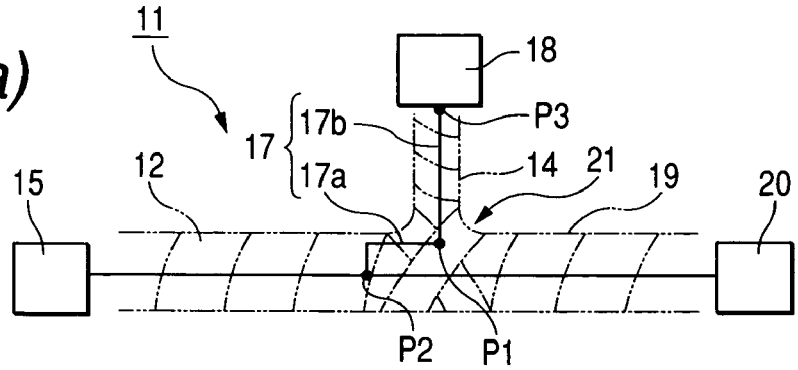
FIGS. 1(*a*) to (*f*) show explanatory views showing an embodiment of a method for manufacturing a wire harness branching portion according to the present invention.
Figure 1B:
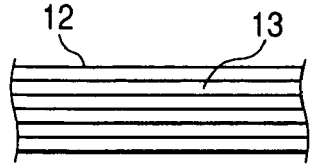
Figure 1C:
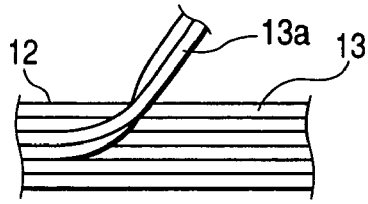
Figure 1D:
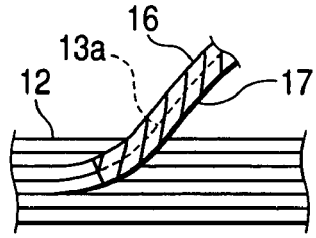
Figure 1E:
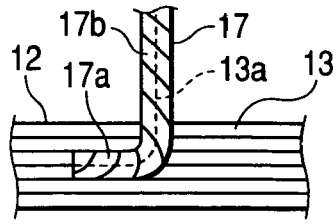
Figure 1F:
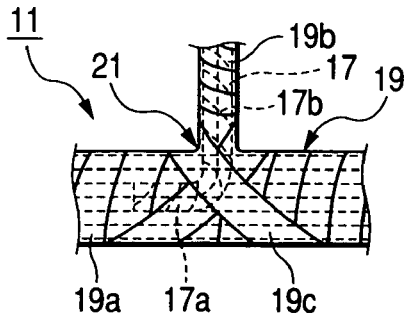

Hereinafter, description will be made with reference to the drawings. FIG. 1 are step explanatory views showing an embodiment of a method for manufacturing a wire harness branching portion of the present invention.

First, as shown in FIGS. 1(*a*) and (*b*), a trunk line 12 of a wire harness 11 is prepared. The trunk line 12 is composed of a plurality of electric wires 13. Next, as shown in FIGS. 1(*a*) and (*c*), from the trunk line 12, electric wires 13*a* to be a branch line 14 are drawn out longer than a required length of the branch line 14. A drawing-out position of the electric wires 13*a* is set so as to be positioned more upstream than a branching position P1, which will be described later, namely, on a connector 15 side provided at one end of the trunk line 12.

Next, as shown in FIGS. 1(*a*) and (*d*), a tape 16 is wound around the drawn-out electric wires 13*a* to form a branch line portion 17. The tape 16 is wound up to the vicinity of the connector 18. The formed branch portion 17 is constructed from its base end P2 (equivalent to the drawing-out position) to the branching position P1 as a trunk line accompanying part 17*a* and from the branching position P1 to a front end P3 (equivalent to the vicinity of a connector 18) as a main branch line part 17*b*. Next, as shown in FIGS. 1(*a*) and (*e*), the trunk line accompanying portion 17*a* is made to accompany the trunk line 12, and the main branch line part 17*b* is bent at the branching position P1 in, for example, a right-angled direction to be distant from the trunk line 12.

Lastly, as shown in FIGS. 1(*a*) and (*f*), an protecting treatment 19 by tape winding is applied to the whole. As this protecting treatment 19, by use of a tape 19*a*, tape winding is carried out from one end of the trunk line 12 to the other end, in other words, from the vicinity of the connector 15 to the vicinity of an opposite connector 20. In addition, as the protecting treatment 19, by use of a tape 19*c*, tape winding by, for example, cross taping is carried out in the vicinity of the branching position P1. By the above, manufacturing of the branching portion 21 of the wire harness 11 is completed.

Figure 2A:
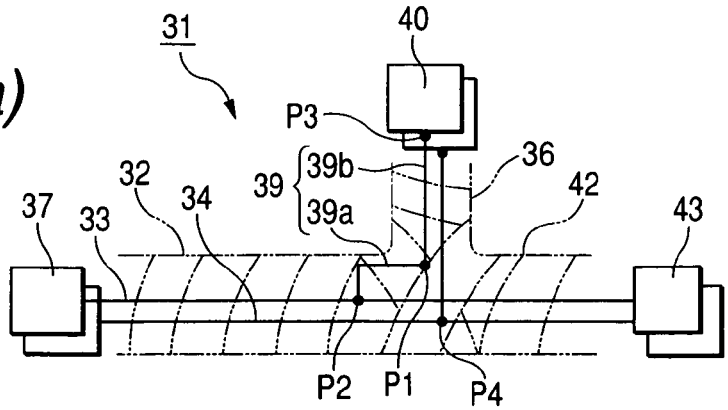
FIGS. 2(*a*) to (*e*) show explanatory views showing another embodiment of a method for manufacturing a wire harness branching portion according to the present invention.
Figure 2B:
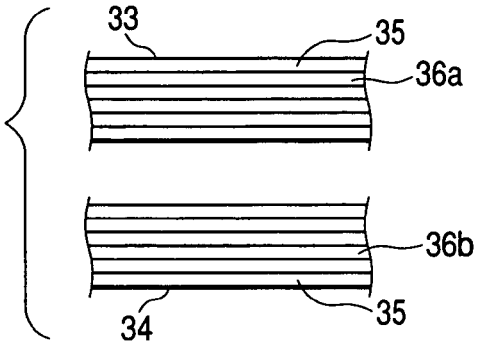
Figure 2C:
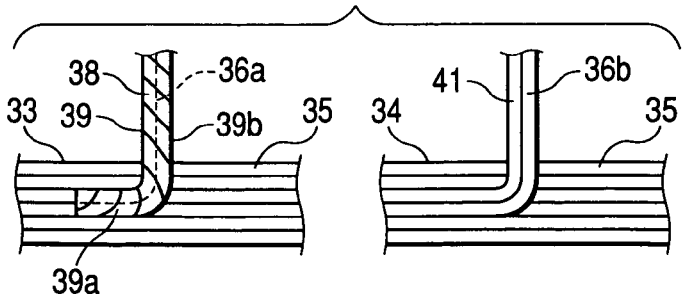
Figure 2D:
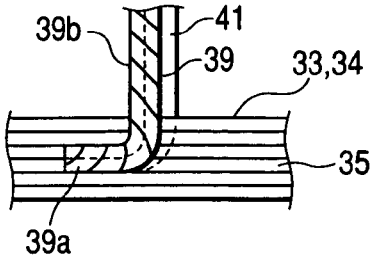
Figure 2E:
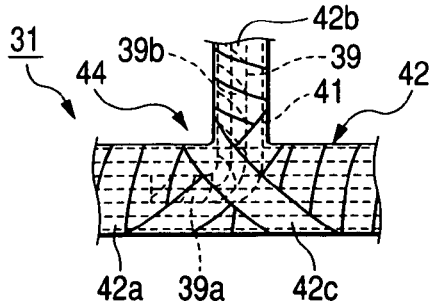

Another embodiment of the present invention will be described with reference to FIG. 2. FIG. 2 are step explanatory views showing another embodiment of the present invention.

First, as shown in FIGS. 2(*a*) and (*b*), as a trunk line 32 of a wire harness 31, a first trunk line 33 including protecting target electric wires and a second trunk line 34 not including protecting target electric wires are separately prepared (the number of trunk lines is provided as an example). The first trunk line 33 and second trunk line 34 are respectively composed of a plurality of electric wires 35. Next, as shown in FIGS. 2(*a*) and (*c*), from the trunk line 33, electric wires 36*a* to be a branch line 36 are drawn out longer than a required length of the branch line 36. The electric wires 36*a* are electric wires to be a protecting target. A drawing-out position of the electric wires 36*a* is set so as to be positioned more upstream than a branch position P1, which will be described later, namely, on a connector 37 side provided at one end of the trunk line 32.

Next, a tape 38 is wound around the drawn-out electric wires 36*a* to form a protecting target branch line portion 39. The tape 38 is wound up to the vicinity of a connector 40. The formed protecting target branch portion 39 is constructed from its base end P2 (equivalent to the drawing-out position) to the branching position P1 as a trunk line accompanying part 39*a* and from the branching position P1 to a front end P3 (equivalent to the vicinity of the connector 40) as a main branch line part 39*b*. Next, the trunk line accompanying portion 39*a* is made to accompany the first trunk line 33, and the main branch line part 39*b* is bent at the branching position P1 in, for example, a right-angled direction to be distant from the first trunk line 33.

Next, as shown in FIGS. 2(*a*) and (*c*), from the second trunk line 34, electric wires 36*b* to be a branch line 36 are drawn out with a required length of the branch line 36. The electric wires 36*b* are electric wires to be a general branch line. Next, the drawn-out electric wires 36*b* are provided as a general branch line portion 41, and this general branch line portion 41 is bent at a branching position P4 in, for example, a right-angled direct-ion to be distant from the second trunk line 34. Next, as shown in FIGS. 2(*a*) and (*d*), while the main branch line part 39*b* and general branch line part 41 are aligned in position, the first trunk line 33 and second trunk line 34 are overlapped.

Lastly, as shown in FIGS. 2(*a*) and (*e*), an protecting treatment 42 by tape winding is applied to the whole. As this protecting treatment 42, by use of a tape 42*a*, tape winding is carried out from one end of the trunk line 32 to the other end, in other words, from the vicinity of the connector 37 to the vicinity of an opposite connector 43, and by use of a tape 42*b*, tape winding is carried out for the main branch line part 39*a* and general branch line portion 41. In addition, as the protecting treatment 42, by use of a tape 42*c*, tape winding by, for example, cross taping is carried out in the vicinity of the branching positions P1 and P4. By the above, manufacturing of the branching portion 44 of the wire harness 31 is completed.

Figure 3A:
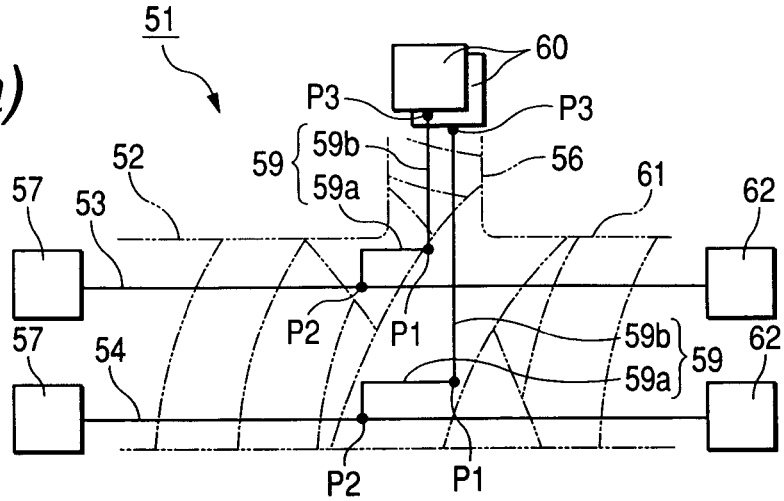
FIGS. 3(*a*) to (*e*) show explanatory views showing still another embodiment of a method for manufacturing a wire harness branching portion according to the present invention.
Figure 3B:
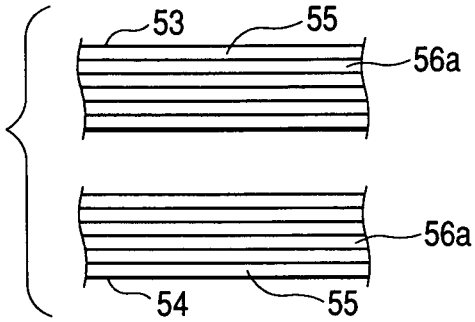
Figure 3C:
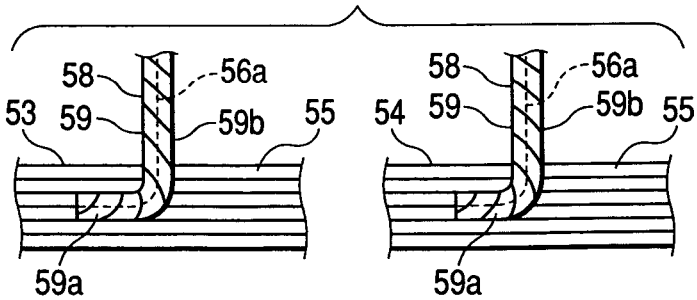
Figure 3D:
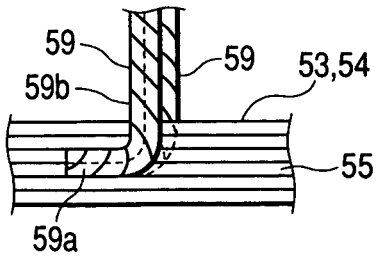
Figure 3E:
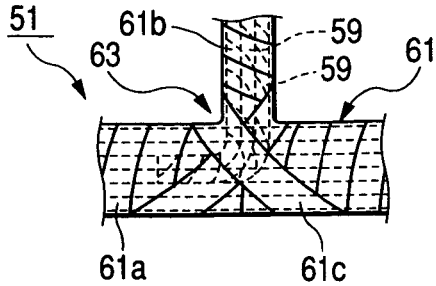
Figure 4A:
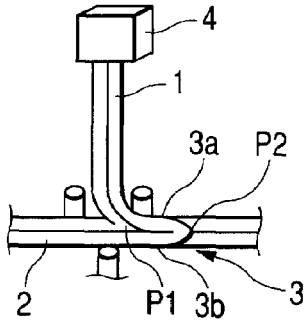
RELATED ART FIG. 4(a)
FIGS. 4(*a*) to (*e*) show explanatory views of a conventional method for manufacturing a wire harness branching portion.
Figure 4B:
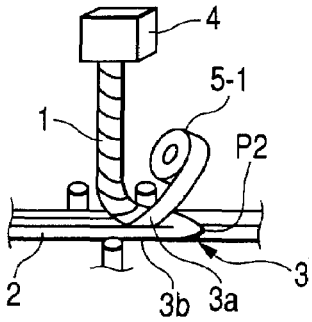
RELATED ART FIG. 4(b)
Figure 4C:
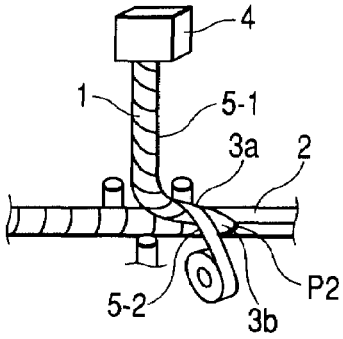
RELATED ART FIG. 4(c)
Figure 4D:
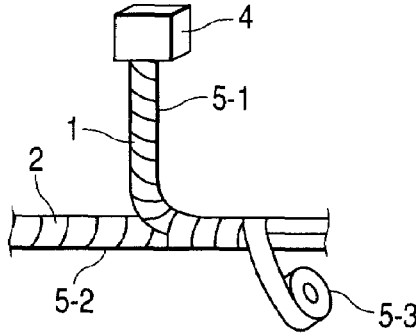
RELATED ART FIG. 4(d)
Figure 4E:
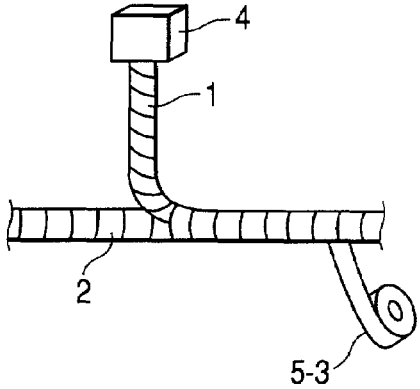
RELATED ART FIG. 4(e)
Figure 5:
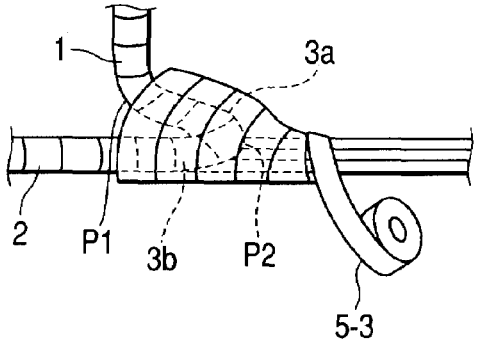
RELATED ART FIG. 5
FIG. 5 shows an explanatory view of a part of FIG. 4 enlarged.

Still another embodiment of the present invention will be described with reference to FIG. 3. FIG. 3 are step explanatory views showing still another embodiment of the present invention.

First, as shown in FIGS. 3(*a*) and (*b*), as a trunk line 52 of a wire harness 51, a first trunk line 53 including protecting target electric wires and a second trunk line 54 not including protecting target electric wires are separately prepared (the number of trunk lines is provided as an example). The first trunk line 53 and second trunk line 54 are respectively composed of a plurality of electric wires 55. Next, as shown in FIGS. 3(*a*) and (*c*), from the first trunk line 53 and second trunk line 54, electric wires 56*a* to be branch lines 56, respectively, are drawn out longer than a required length of the branch lines 56. The electric wires 56*a* are electric wires to be a protecting target. Drawing-out positions of the electric wires 56*a* are set so as to be positioned more upstream than a branch position P1, which will be described later, namely at a connector 57 side provided at one end of the trunk line 52.

Next, a tape 58 is wound around the drawn-out electric wires 56*a* to form protecting target branch line portions 59, respectively. The tape 58 is respectively wound up to the vicinity of a connector 60. The formed protecting target branch portions 59 are constructed from their each base end P2 (equivalent to the drawing-out position) to each branching position P1 as a trunk line accompanying part 59*a* and from each branching position P1 to each front end P3 (equivalent to the vicinity of the connector 60) as a main branch line part 59*b*. Next, the trunk line accompanying portions 59*a* are made to accompany the first trunk line 53 and second trunk line 54, respectively, and the main branch line parts 59*b* are bent at the branching position P1 in, for example, a right-angled direction to be distant from the first trunk line 53 and second trunk line 54.

Next, as shown in FIGS. 3(*a*) and (*d*), while the main branch line parts 59*b* are aligned in position with each other, the first trunk line 53 and second trunk line 54 are overlapped. Lastly, as shown in FIGS. 3(*a*) and (*e*), an protecting treatment 61 by tape winding is applied to the whole. As this protecting treatment 61, by use of a tape 61*a*, tape winding is carried out from one end of the trunk line 52 to the other end, in other words, from the vicinity of the connector 37 to the vicinity of an opposite connector 62, and by use of a tape 61*b*, tape winding is carried out for the main branch line parts 59*b*. In addition, as the protecting treatment 61, by use of a tape 61*c*, tape winding by, for example, cross taping is carried out in the vicinity of the branching position P1. By the above, manufacturing of the branching portion 63 of the wire harness 51 is completed.

In the above-described three embodiments, according to the present invention, manufacturing steps of shifting the drawing-out position of electric wires to be a branch line to a more upstream side than the branching position and protecting the section between the drawing-out position and branching position by tape winding are included. Namely, a manufacturing step of protecting, not only the section from the branching position to the front end of the branch line, but also the upstream side beyond the branching position by tape winding is included.

For each of the above-described three embodiments, unlike the prior art, it is unnecessary to lengthen the length of electric wires composing the branch line. In addition, it is also unnecessary to provide a U-turn formed turning portion as in the prior art. Accordingly, an advantage is provided in that productivity can be heightened to provide a wire harness branching portion at a low price. In addition, as described above, since it is unnecessary to provide a U-turn formed turning portion as in the prior art, an advantage is provided in that occurrence of wire breaking can be prevented and durability can be improved. Furthermore, an advantage is provided in that a compact wire harness branching portion can be manufactured.

Moreover, as a matter of course, the present invention can be variously modified and embodied without departing from the spirit thereof.

What is claimed is:

1. A method for manufacturing a wire harness branching portion comprising the steps of:

drawing out, from a trunk line of a wire harness electric wires to be a branch line, said drawn out portion being longer than a required length of the branch line;

forming a branch line portion by applying tape winding to the drawn-out electric wires, wherein the forming of the branch line portion comprises applying the tape winding to a trunk line accompanying part and a main branch line part, the trunk line accompanying part defined from a proximal end of the branch line portion to a branching position of the branch line portion, and the main branch line part defined from the branching position of the branch line portion to a distal end of the branch line portion;

maintaining the trunk line accompanying part with the trunk line while extending the main branch line part from the branching position and without folding the branch line portion into a U-turn shape;

keeping the main branch line part away from the trunk line; and applying a protecting treatment by tape winding to the trunk line and at least the trunk line accompanying part without forming the U-turn shape in the trunk line accompany part;

wherein opposite ends of the trunk line are connected to connectors, respectively, and wherein the protecting treatment is applied by tape winding to the trunk line and at least the trunk line accompanying part from a vicinity of one of the connectors to a vicinity of another of the connectors without forming the U-turn shape in the trunk line accompanying part;

further comprising:

drawing out, from a second trunk line, a general branch line portion defined by electric wires to be a general branch line with a required length of the branch line;

keeping the general branch line portion distant from the second trunk line; and overlapping the first trunk line and second trunk line while aligning the main branch line part and the general branch line portion in position;

wherein the applying the protecting treatment by tape winding to the trunk line and at least the accompanying part comprises applying the protecting treatment by winding tape to the trunk line, the second trunk line, and at least the trunk line accompanying part.

2. A method for manufacturing a wire harness branching portion comprising the steps of:

drawing out, from a trunk line of a wire harness, electric wires to be a branch line, said drawn out portion being longer than a required length of the branch line;

forming a branch line portion by applying tape winding to the drawn-out electric wires, wherein the forming of the branch line portion comprises applying the tape winding to a trunk line accompanying part and a main branch line part, the trunk line accompanying part defined from a proximal end of the branch line portion to a branching position of the branch line portion, and the main branch line part defined from the branching position of the branch line portion to a distal end of the branch line portion;

maintaining the trunk line accompanying part with the trunk line while extending the main branch line part from the branching position and without folding the branch line portion into a U-turn shape;

keeping the main branch line part away from the trunk line; and applying a protecting treatment by tape winding to the trunk line and at least the trunk line accompanying part without forming the U-turn shape in the trunk line accompany part;

wherein opposite ends of the trunk line are connected to connectors, respectively, and wherein the protecting treatment is applied by tape winding to the trunk line and at least the trunk line accompanying part from a vicinity of one of the connectors to a vicinity of another of the connectors without forming the U-turn shape in the trunk line accompanying part, further comprising:

forming a second protecting target branch line by applying tape winding to drawn-out electric wires of a second trunk line, wherein the forming of the second branch line comprises applying the tape winding to a second trunk line accompanying part and a second main branch line part, the second trunk line accompanying part defined from a proximal end of the second branch line to a second branching position of the second branch line portion, and the second main branch line part defined from the second branching position of the second branch line portion to a distal end of the second branch line;

accompanying the trunk line accompanying part and the second trunk line accompanying part with the trunk line and the second trunk lines, respectively;

keeping the main branch line part and the second main branch line part distant from the trunk line and the second trunk line, respectively; and overlapping the trunk line and the second trunk line with each other while aligning the main branch line part and the second main branch line part in position with each other;

wherein the applying the protecting treatment by tape winding to the trunk line and at least the truck line accompanying part comprises applying the protecting treatment by winding tape to the trunk line, the second trunk line, and at least the truck line accompanying part and the second trunk line accompanying part.

* * * * *